United States Patent [19]

Denny et al.

[11] 4,317,018

[45] Feb. 23, 1982

[54] FAIL SAFE CONTROL CIRCUIT

[75] Inventors: Richard W. Denny, Littleton; Paul A. Diddens, Denver, both of Colo.

[73] Assignee: Honeywell, Inc., Minneapolis, Minn.

[21] Appl. No.: 242,969

[22] Filed: Mar. 12, 1981

[51] Int. Cl.[3] ..... H05B 1/02

[52] U.S. Cl. ..... 219/216; 346/151; 307/118; 219/501; 219/497; 219/388; 361/6; 323/237

[58] Field of Search ..... 219/216, 388, 497, 499, 219/493, 506, 507, 501, 469, 508–510; 307/117, 118; 236/46 R; 323/235, 237, 246; 361/5–7, 37, 42, 242; 346/151

[56] References Cited

U.S. PATENT DOCUMENTS 3,584,291 6/1971 Budniak ..... 219/501

3,588,445 6/1971 Hopkins ..... 219/501

4,267,434 5/1981 Simpson ..... 219/499

*Primary Examiner*—B. A. Reynolds

*Assistant Examiner*—M. H. Paschall

*Attorney, Agent, or Firm*—Lockwood D. Burton; Mitchell J. Halista

[57] ABSTRACT

In a control circuit to prevent the overheating of a conductively backed recording medium, a closed loop control circuit is provided wherein heat is provided to the heating electrodes of the circuit by one subcircuit under the control of a speed responsive control subcircuit. A feedback loop to a summing junction in the latter subcircuits is monitored to determine a deviation from virtual zero at that junction. A deviation from such virtual zero at that junction is used to control a shutdown safety circuit.

14 Claims, 1 Drawing Figure

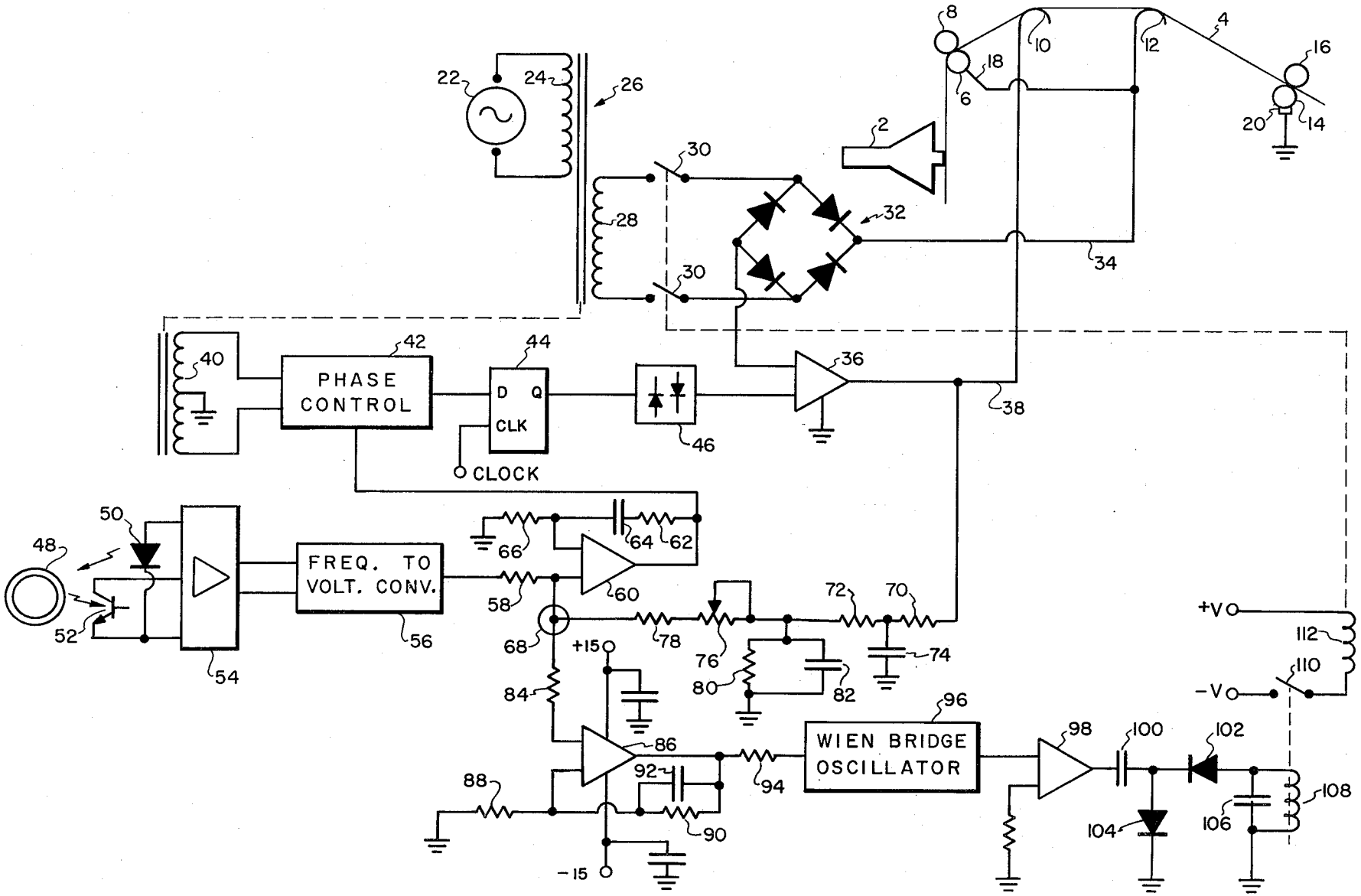
WIEN BRIDGE OSCILLATOR
PHASE CONTROL
FREQ. TO VOLT. CONV.
CLOCK
D
Q
CLK
+V
-V
+15
-15

FAIL SAFE CONTROL CIRCUIT

CROSS REFERENCE

Cross reference is made to a copending application of Gary R. Simpson Ser. No. 48,483 filed June 14, 1979 for A Method and Apparatus for Heat Processing Photosensitive Material.

BACKGROUND OF THE INVENTION

The present invention relates to recording apparatus. More particularly it relates to a fail safe shutdown circuit for a recording apparatus.

In the recording art, there has been provided a form of recording wherein a photosensitive recording medium is exposed to light images to produce latent images thereon. Those latent images are then developed by the application of heat to the photosensitive emulsion bearing the latent images. In one form of such medium, a photosensitive emulsion is carried on one surface of a base member while an electrically conductive backing coating is applied to the other surface of the base member. After exposure to the light images, the recording medium is drawn across a plurality of electrodes with the electrodes engaging the conductive backing on the record medium. The electrodes are energized with electrical energy to pass electrical current through the conductive backing. That electrical current is controlled to provide the desired heating to effect the proper development of latent images on the emulsion side of the record medium. Inasmuch as the record medium may be driven at any of a plurality of selected speeds, it is apparent that the required current will of necessity be varied in accordance with the selected speeds in order to provide the required heating effect to produce a desired development.

If too much energy is applied to the record medium, especially at low speeds, the record medium may catch fire, due to the excessive heat in the conductive backing. The temperature of the backing is very difficult to sense directly. The thermal mass of the record medium is so small that if anything actually touches the record medium it will be cooled slightly in that area and the image will not develop as fully as the rest of the image. This will leave an undeveloped streak on the record. In previous efforts to accomplish the desired result, a very small thermistor was mounted very near but not touching the record member. This method has not proved entirely satisfactory for several reasons.

In order to respond quickly enough to prevent a fire, approximately four seconds, the thermistor must be very small and is therefore very fragile. It must be suspended in air by its tiny leads whereby the surrounding surfaces will not sink the heat away from it. Since it is uncovered or exposed when a record member is being loaded into the apparatus, it must also be protected from damage by operators fingers. Such protection is inconsistent with the thermistor being close to the record member. If the thermistor is not close to the record member, it will not respond quickly enough to prevent a fire.

The sensing circuit which detects the thermistors temperature must be adjusted very precisely. If the limiting temperature is set too high, the paper will catch fire before the safety circuit is actuated. If the limiting temperature is set too low, the safety circuit will be actuated whenever the record member is run at low speed for a long period of time. Nuisance tripping such as this, is of course not acceptable. Additionally, the correct setting of the thermistor and the accompanying circuit involves considerable setup time by production technicians and wastes a significant amount of the expensive record medium, due to the long runs at low speeds which are necessary in order to assure a proper setup.

Further, the thermistor bead is sensitive to debris. When the system has been operated for any significant length of time, small particles may accumulate on the thermistor bead and will partially insulate it and thus slow the response time.

Finally the thermistor circuit, as explained above, was not fail-safe and was easily subject to human error.

SUMMARY OF THE INVENTION

It is, accordingly, an object of the present invention to provide an improved control system which obviates the shortcomings of the hereinbefore mentioned controller control systems.

It is another object of the present invention to provide an improved control circuit as set forth which is fail safe in nature.

In accomplishing these and other objects, there has been provided, in accordance with the present invention a control circuit to prevent the overheating of a conductively backed recording medium. A closed loop control circuit is provided wherein heat is provided to the heating electrodes of the circuit by one subcircuit under the control of a speed responsive control subcircuit. A feedback loop to a summing junction in the latter subcircuits is monitored to determine a deviation from virtual zero at that junction. A deviation from such virtual zero at that junction is used to control a shutdown safety circuit.

BRIEF DESCRIPTION OF THE DRAWINGS

A better understanding may be had from the following description when read in the light of the accompanying drawings in which:

The single FIGURE is a schematic block diagram of a circuit embodying the present invention.

DETAILED DESCRIPTION

Referring now to the drawing in more detail, there is shown in the single figure a cathode ray tube 2 having a fiber optic face plate. A recording medium 4 of the type having a photosensitive emulsion on one side of a base carrier and an electrically conductive backing surface on the other side of the carrier is drawn across the face of the cathode ray tube with the emulsion side facing the fiber optics face plate. The record member 4 is drawn past the cathode ray tube 2 by a first driving roller 6 in cooperation with a pinch roller 8. From the driving roller 6, the record member 4 is drawn past a first and a second resilient electrode 10 and 12 by a second driving roller 14 in cooperation with a second pinch roller 16. The first and second drive rollers 6 and 14 are each electrically conductive members. A brush assembly 18 electrically connects the roller 6 to the second resilient electrode 12. Similarly a brush assembly 20 connects the roller 14 to ground. The rollers 6 and 14 as well as the electrodes 10 and 12 engage the electrically conductive backing surface of the record medium 4.

A source of AC energy 22 is connected to the primary winding 24 of a transformer 26. A first secondary winding 28 on the transformer 26 is connected through a pair of switches 30 to the input terminals of a full-wave rectifier 32. One output terminal of the rectifier bridge 32 is connected by a lead 34 to the flexible electrode 12 and to the first driving roller 6. The other output terminal of the rectifier bridge 32 is connected to one input terminal of an amplifier 36. The output of the amplifier 36 is connected by a lead 38 to the first flexible electrode 10. A second secondary winding 40 on the transformer 26 is connected to the input terminals of a phase control network or loop 42. The output of the phase control network 42 is connected to the D input of a flipflop 44. The flipflop 44 is enabled by a clock signal applied to the clock input terminal thereof from a source not constituting a part of the present invention. The Q output of the flipflop 44 is connected to the input of an isolating element such as an optical isolator 46. The output of the optical isolator is connected to the second input of the amplifier 36.

As was previously noted, the energy applied to the heating of the record member 4 is determined to be a function of the velocity with which the record member is being drawn through the system. In order to accomplish such a relationship, a tachometer tone wheel 48 is arranged to be driven by the record member driving system. A signal is generated from the tone wheel 48 as by a light emitting diode 50 and a light sensitive transistor 52. The signal generated from the tone wheel 48 as applied to the input of an amplifier circuit 54. The signal thus generated and amplified is a pulse signal having a frequency which is proportional to the velocity of the movement of the record member 4. The output of the amplifier 54 is applied to the input of a frequency to voltage converter 56. The output of the frequency to voltage converter 56, a DC signal, is applied through a coupling resistor 58 to the input of an operational amplifier 60. The output of the amplifier 60 is connected first, through a feedback resistor 62 and a serially connected capacitor 64 to the other input terminal of the operational amplifier 60. A resistor 66 is also connected between the other input of the amplifier 60 and ground. The output of the amplifier 60 is also connected as a control input signal to the phase control circuit 42.

The resulting output signal from the amplifier 36 is also connected in a feedback loop to a summing junction 68 connected to the first mentioned input terminal of the amplifier 60. This feedback loop includes a filtering r-c network including a first and second serially connected resistor 70 and 72 and a shunting capacitor 74. A variable resistor 76 and a serially connected load resistor 78 are connected between the resistor 72 and the junction 68. A parallel connected resistor 80 and capacitor 82 are connected between the junction of the resistors 72 and 76 and ground. The feedback from the output of the amplifier 36 to the junction 68 at the input of the amplifier 60 provides a closed-loop control for the heating energization of the electrodes 6, 10, and 12.

The voltage at the junction 68 is monitored by a safety circuit. The safety circuit includes a coupling resistor 84 connected between the summing junction 68 and a first input terminal of an operational amplifier 86. The other input terminal of the amplifier 86 is connected through a resistor 88 to ground. The output of the amplifier 86 is connected through a resistor 90 and the capacitor 92 to the second input of the amplifier 86 thus forming a closed feedback loop around the amplifier 86. The output of the amplifier 86 is also connected through a coupling resistor 94 to the input of a Wien bridge oscillator 96 it will be noted that the amplifier 86 is energized between a positive and a negative 15 volt power supply. There is no energization internally reference to ground.

The output of the Wien bridge oscillator is connected to a buffer amplifier 98. The output of the buffer amplifier 98 is coupled through a coupling capacitor 100 to a charge pump arrangement comprising a first diode 102 and a second diode 104 which are operative to charge a capacitor 106. A relay coil 108 is connected across the capacitor 106. The relay coil 108 controls the actuation of a switch 110. The switch 110, in turn, controls the energization of a second relay coil 112. That relay coil 112, in turn, controls the operation of the switches 30. While the system is shown utilizing the first relay 108 to control the energization of the second relay 112, as for a current-gain consideration, it should be noted that the relay 108 may be connected to control the actuation of the switches 30, directly.

In operation, with the switches 30 closed, a relatively high voltage, on the order of 230 volts AC, is developed across the transformer secondary winding 28 and applied to the input terminals of the full-wave rectifier 32. The application of the pulsed output from the rectifier 32 to the electrodes 10 and 12 and the roller 6 is controlled by the amplifier 36. The signal developed across the secondary winding 40 is a signal which is synchronized with the output signal from the secondary winding 28. The output of the phase control unit 42 is a square-wave signal having a duty cycle which is variable as a function of the output signal from the voltage-to-frequency converter amplifier 60. That output signal is applied to trigger the flipflop 44 in accordance therewith. The output of the flipflop 44 is connected through the optical isolator 46 to the input of the power control amplifier 36.

Inasmuch as the power circuit coupled from the secondary winding 28 is a relatively high voltage circuit, the optical isolator 46 separates that circuitry from the much lower voltage circuit relating to the phase control. The control signal transmitted by the optical isolator 46 effectively triggers the power amplifier 36 between a fully on and fully off condition in accordance with the applied control signal.

Since the output of the full-wave rectifier 32 is unfiltered, the power signals applied to the input of the amplifier 36 comprise a succession of voltage pulses at twice the frequency of the signal source 22. The control signal applied to the amplifier 36 from the phase control circuits through the flipflop 44 and the isolator 46 causes the amplifier 36 to be turned on for a selected portion of each of those pulses, thereby controlling the net power applied to the electrodes for heating the record member 4. The faster the record member 4 is being driven through the apparatus, the more heat is required to effect a proper development of the latent images since less time is allotted between the succession of the electrodes. A greater amount of heat is accomplished by supplying a greater amount of energy to the electrodes. The increased energy is, in turn, accomplished by controlling the size of the portion of each of the pulses that is to be transmitted through the amplifier 36. The phase control signals accomplish such proportioning The voltage signal produced at the output of the frequency to voltage converter 56 and transmitted through the coupling resistor 58 to the summing junction 68 controls the heating energy output by the amplifier 36. The feedback signal applied from the output of the amplifier 36 through the filtering network to the summing junction 68 tends to maintain the voltage at the summing junctions 68 at or near zero.

The actual voltage at the summing junction 68 is monitored by the amplifier 86. The amplifier 86, in an apparatus constructed in accordance with the present invention, exhibited a gain of about 13. The output of that amplifier 86 is, as previously mentioned, connected to the input of a Wien bridge oscillator 96. Again, as embodied in a circuit constructed in accordance with the present invention, the Wien bridge oscillator was so characterized that if the output voltage of the amplifier 86 exceeded the range of plus or minus 3.6 volts, the Wien bridge oscillator would cease to oscillate. In other words, if the output of the amplifier remains between plus 3.6 volts and minus 3.6 volts the Wien bridge oscillator will continue to oscillate. With a gain factor of the exemplary 13 in the amplifier 86, a deviation of the summing junction 68 by as little as 0.3 volts plus or minus, will cause the Wien bridge oscillator 96 to cease oscillating. So long as the oscillator 96 continues to be activated, an oscillatory output is fed through the amplifier 98 and the capacitor 100 to the pump-charge circuitry including the diodes 102 and 104 to apply a charge across the capacitor 106. As long as the charge across the capacitor 106 is maintained, the relay 108 will be energized, maintaining the switch 110 in a closed condition. With the switch 110 in a closed condition, the relay 112 is energized and the switches 30 are maintained in a close condition, thereby allowing the electrodes 10, 12 and the roller 6 to be energized supplying heating current to the conductive backing on the record member 4.

If, for any reason, the output signal from the amplifier 36 is significantly greater than or less than the power called for by the output signal from the frequency-to-voltage converter 56, the voltage at the summing junction 68 will deviate from the virtual zero. Such deviation will cause the output signal from the amplifier 86 to exceed the input limit of the Wien bridge oscillator, causing that oscillator to cease oscillating. With the oscillator not operating, no energy is supplied to the relay coil 108, causing the switch 110 to be opened. The opening of the switch 110 causes the relay 112 to be deenergized, thereby opening the switches 30. Opening of the switches 30 causes a deenergization of the electrodes 10, 12, and 6. Thus there has been provided, in accordance with the present invention, a control system for monitoring the heating current applied to a conductive back recording medium to prevent the application of excessive heating current thereto, which excessive current could lead to a fire in the record medium. Additionally the monitoring is accomplished without the use of a thermal sensor attempting to physically measure the actual temperature of the second medium.

In apparatus of the type herein setforth it is highly desirable that the apparatus be defined as fail-safe. That is, that if any of the active components, fail either in short circuits or in open circuits, the safety shutoff mechanism will operate to prevent the overheating of the record member. The present apparatus fulfills this requirement.

If any of the components in the base control circuit 42, the flipflop 44, or the amplifier 36 fail, either by short circulating or by open circuiting, the potential at the summing junction will be moved away from zero by an amount sufficient to stop the oscillation of the Wien bridge oscillator 96. As previously noted, when the Wien bridge oscillator ceases to oscillate, the switch 110 will be opened thereby causing the switches 30 to be opened. similarly if any of the components in the tone signal generator circuit, the amplifier 54 or the frequency-to-voltage converter 56 fails, again the potential at the summing junction 68 will be moved away from zero, resulting in the opening of the switches 30.

It will be recalled that the amplifier 86 is energized between a plus 15 and a minus 15 volt supply, there is no internal reference to ground. Therefore if any element in the amplifier 86 is opened or shorted the output will either go to minus 15 or plus 15 volts either of which will cause the Wien bridge oscillator to cease oscillating, again opening the switches 30. Any failure within the Wien bridge oscillator, itself, will cause a cessation of oscillation and a steady state voltage signal will not be transmitted by the capacitor 100. Similarly should any failure occur in the buffer amplifier 98 the steady state resulting signal would not be transmitted to the relay 108 by the capacitor 100. Therefore under any of these conditions the switches 30 would be opened and power removed from the heating surface of the record element 4.

Thus it may be seen that the herein described circuit not only accomplishes the monitoring of the heating current supplied to the record member but is also fail safe.

The embodiments of the present invention in which an exclusive property of privilege is claimed are defined as follows:

1. An energization control circuit for dynamically controlling the flow of electrical current to a utilization means comprising:

an energy loop including means connected to a current source means, a current control means, switch means conneced between said current control means and said means connected to said current source means, said current control means having an output for connection to said utilization means;

a control loop including a condition responsive signal generating means, an operational amplifier having an input at a summing junction connected to the output of said signal generating means, a control signal generating means having a control input connected to the output of said operational amplifier, said control signal generating means having an output connected to a control input of said current control means, and a feedback network connected between said output of said current control means and said summing junction; and a safety shut-off loop connected to said summing junction and including means responsive to a voltage signal at said summing junction to provide a deviation indicative signal, an oscillator connected to be responsive to said deviation indicative signal, said oscillator being operative to provide an oscillatory output signal only when said deviation indicative signal is between predetermined limiting values, and means connected to said oscillator to be responsive to said oscillatory output signal to maintain said switch means closed only during the continuance of said oscillatory output signal.

2. A control circuit as set forth in claim 1 wherein said oscillator comprises a Wien bridge oscillator.

3. A control circuit as set forth in claim 1 wherein said means to provide said deviation indicative signal comprises an operational amplifier.

4. A control circuit as set forth in claim 2 wherein said means to provide said deviation indicative signal comprises an operational amplifier and wherein said means connected to be responsive to said oscillatory signal includes a buffer amplifier.

5. A control circuit as set forth in claim 4 wherein said means connected to be responsive to said oscillatory signal further includes a relay means and a coupling capacitor connected between said relay means and said buffer amplifier.

6. A control circuit as set forth in claim 5 and further including a pump-charge network connected between said coupling capacitor and said relay.

7. A control circuit as set forth in claim 6 wherein said relay means is connected to control the operation of said switch means.

8. A control circuit as set forth in claim 7 wherein said relay means includes a first relay and a second relay, said first relay having a contact switch operative to control the energization of said second relay and said switch means being contacts of said second relay.

9. A control circuit as set forth in claim 3 wherein said utilization means comprises electrodes for conducting current to a conductive backed recording medium.

10. A control circuit as set forth in claim 9 wherein said condition responsive signal generating means comprises:

a tachometer signal generator for providing a signal having a frequency representing the linear velocity of said recording medium, and a frequency-to-voltage converter means connected to the output of said tachometer signal generator.

11. A control circuit as set forth in claim 10 wherein said current source means comprises an a.c. source means and including a full-wave rectifier connected between said source means and said current control means.

12. A control circuit as set forth in claim 11 wherein said control signal generating means includes means producing a signal synchronous with said a.c. source means, and phase control means connected thereto for producing a variable duty-cycle output signal, said phase control means being responsive to said output of said operational amplifier.

13. A control circuit as set forth in claim 12 wherein said current control means comprises a current control amplifier.

14. A control circuit as set forth in claim 13 wherein said variable duty cycle output signal is applied to control the on-off condition of said current control amplifier.

* * * * *